United States Patent [19]

Strobe et al.

[11] 4,023,703

[45] May 17, 1977

[54] EASY-OPEN CONTAINER WITH FLANGE PUSH-IN MEMBER

[76] Inventors: Carl J. Strobe, 2831 Orchard Knob, Atlanta, Ga. 30309; Robert A. Wells, 4450 Harris Trail NW., Atlanta, Ga. 30327

[22] Filed: May 27, 1975

[21] Appl. No.: 580,624

[52] U.S. Cl. ..... 220/268; 220/345

[51] Int. Cl.[2] ..... B65D 41/32

[58] Field of Search ..... 220/265–277, 220/345; 222/541

[56] References Cited

UNITED STATES PATENTS

| | | | |
|---|---|---|---|
| 3,236,409 | 2/1966 | Cross et al. | 220/260 |
| 3,874,555 | 4/1975 | Patarini et al. | 220/269 |
| 3,915,333 | 10/1975 | Peyser et al. | 220/268 |
| 3,934,750 | 1/1976 | Herbst | 220/268 |

*Primary Examiner*—George T. Hall

[57] ABSTRACT

An easy-open container having a wall in which an openable member is integrally formed and defined by a selectively separable region. The openable member has an opening tab which is raised outwardly from the container wall, with the opening tab having a flange which overhangs at least part of the separable region. Finger pressure applied inwardly onto the opening tab toward the container wall causes the separable region to become ruptured, allowing the openable member to move inwardly with respect to the wall. Inward movement of the openable member is limited by the overhanging flange which contacts the periphery of the opening. In some embodiments, the separated opening member is retained on the container wall and is then displaced to reveal an opening in the container wall for access to the contents of the container. In other embodiments, the opening member becomes detachable from the container wall. Several openable members are disclosed which can reclose the opened container. The opening tab may be an integral part of the openable member, or may be a separate element which is attached to the openable member.

47 Claims, 62 Drawing Figures

EASY-OPEN CONTAINER WITH FLANGE PUSH-IN MEMBER

This invention relates in general to containers and in particular to easy-open containers of the type typically used for commodities such as beverages and the like.

The widespread popularity of easy-open containers, particularly containers of the well-known "poptop" variety used for beverages and the like, has created problems because of the complete removability from the container of the tear tab or other easy-opening structure. The removable tear tabs, which usually have rough torn metal edges, have created a litter problem which is both unsightly and hazardous. Moreover, the relatively small size of the typical pop-top tear tab seemingly invites improper disposal of the tear tab, since such tabs are frequently found underfoot in even the more remote locations.

Notwithstanding the disadvantages of the removable tear tab which accompanies the conventional pop-top container, consumer acceptance of such containers is high because these containers are readily openable by people of nearly all ages, without resort to can openers or other external implements. Because of this popularity, numerous attempts have been made to provide alternative easy-opening containers which provide the advantages of the conventional pop-top while overcoming the aforementioned litter problem. Such prior art alternative containers are not known to have met with any degree of commercial success, however, because these containers proved difficult to open or were excessively expensive to manufacture. Moreover, some proposed easy-open containers present the user with the real or perceived possibility that his finger may suddenly be propelled through the sharp edges of an opening from which a tear tab has just been removed. Containers which present this hazard, whether real or merely perceived, have been completely unacceptable to beverage maufacturers as well as consumers in test market situations.

According to the present invention, accordingly, there is provided a unique and novel easy-open container in which an openable member integral with a wall of the container is defined in the wall by a selectively separable region of predetermined weakness. The openable member is formed to have an opening tab which extends outwardly from the container wall, and a recess may be defined in the opening tab for receiving finger pressure directed inwardly toward the container wall. A portion of the openable member overhangs the selectively separable region to limit the inward movement of the separated openable member, thereby preventing entry of the button and one's finger into the opening which is provided by rupture of the separable region. The separated opening member can thereafter either be completely removed from the container wall, or can alternatively be retained on the container wall by appropriate structural means; the retained openable member is selectively displaceable relative to the container wall for access to the contents of the container.

Accordingly, it is an object of the present invention to provide improved easy-open container apparatus.

It is another object of the present invention to provide improved easy-open container apparatus in which a separable opening member is retained on the opened container.

It is yet another object of the present invention to provide an easy-open container of relatively economical construction, in which the openable portion cannot be detached from the remainder of the container.

It is still another object of the present invention to provide an easy open container wall of unitary construction.

It is a further object of the present invention to provide an easy-open container in which the opening structure has neither the real nor the apparent capability of allowing a person's finger to accidentally enter the container during opening.

It is still another object of the present invention to provide an improved easy-opening container that is reclosable after being opened.

Other objects and advantages of the present invention will become more readily apparent from the following description of several disclosed embodiments thereof, including the drawings in which.

Figure 1:
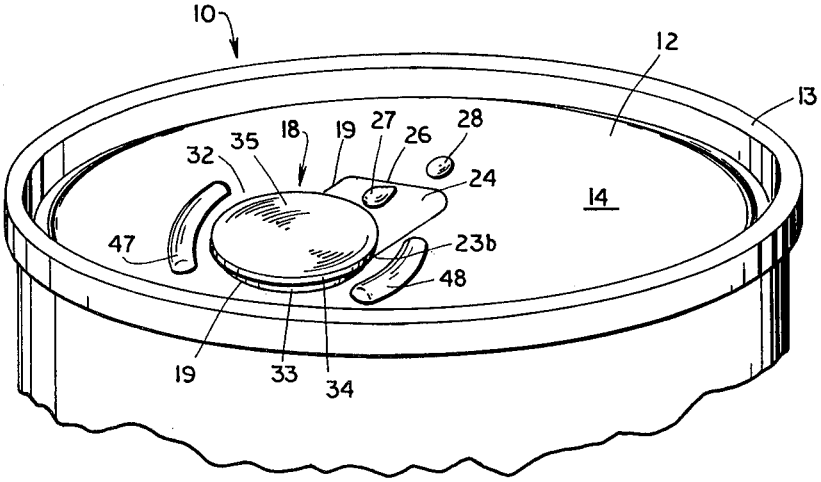
FIG. 1 shows a fragmentary pictorial view of a container including an end wall provided with easy-opening structure according to one disclosed embodiment of the present invention.

Turning first to the embodiment shown in FIGS. 1-5, there is shown a fragmentary container indicated generally at 10 and having a generally cylindrical body wall 11 and an end wall 12 secured to the body wall by the peripheral chime 13 which extends a short distance beyond the outside surface 14 of the end wall, in a manner well-known to those skilled in the art. It will be understood that the non-depicted portion of the container 10 includes the remainder of the body wall 11 and another end wall, which may be formed integrally with the body wall or which may alternatively be a separate end member which is fastened to the body wall.

Figure 3:
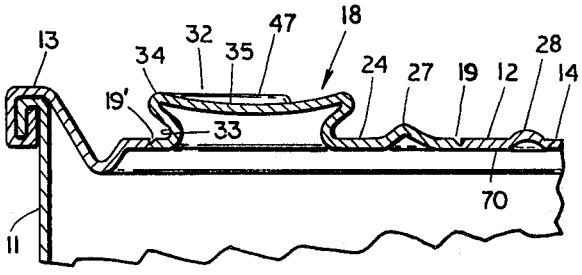
FIG. 3 is an elevation view taken along line 3—3 of FIG. 2.
Figure 3A:
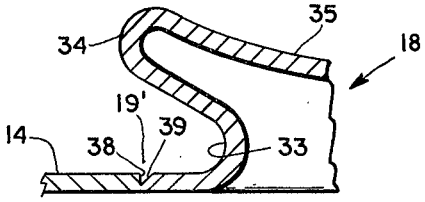
FIG. 3A is an enlarged fragmentary view of the score line use in the embodiment of FIG. 3.

Located in the end wall 12 is the openable member indicated generally at 18 and defined in the end wall by the line 19 of predetermined structural weakness formed in the end wall. Assuming that the end wall 12 is made of thin metal such as aluminum or the like, the line of weakness 19 can be provided by a score line which is stamped into the wall in a manner known to those skilled in the art. The score line 19 may extend only partially through the thickness of the end wall 12, as best shown in FIGS. 3 and 3A, or may alternatively be a repaired score in which the openable member 18 is initially severed from the end wall at the time of manufacture, after which the severed end wall is repaired by applying a suitable sealant composition along the line of severing at the inside surface 20 of the end wall. Various types of metal scoring techniques and metal weakening techniques used in easy-open container construction are known to those skilled in the art and, with an exception below, are not repeated in further detail herein.

The line of weakness 19, hereinafter called a "score line" without regard to its manufacturing technique, which defines the openable member 18 is an uninterrupted line, so that the openable member is completely separated from the remainder of the end wall 12 when the score line becomes separated. The score line 19, in the embodiment of FIGS. 1–5, thus defines the openable member as including an arcuate portion defined by the score line segment 19' which, in the presently-discussed embodiment, is curvilinear and extends over slightly more than 180° to join at 23*a* and 23*b* with the remainder of the score line which defines a tab section 24 extending generally toward the center of the end wall 12. The tab section 24, in the present embodiment, includes and is defined in part by a pair of spaced-apart sides 25*a* and 25*b* and by the outer end 26.

Formed in the tab section 24 is an outwardly-extending locking detent 27, which is aligned with a mating locking dimple 28 formed in the inside surface 20 of the end wall 12. The purpose and operation of the locking detent 27 and the locking dimple 28 are explained below. Both the locking detent 27 and the locking dimple 28 are preferably formed by a stamping operation during the manufacture of the end wall 12.

Figure 2:
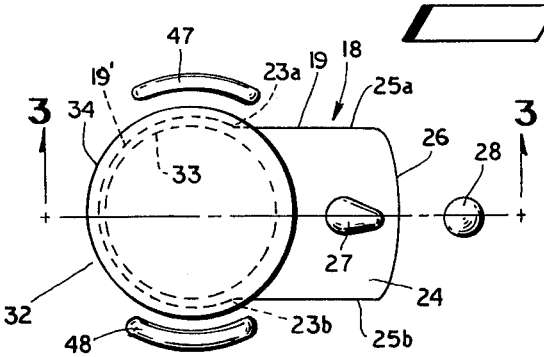
FIG. 2 shows a top view of the container end shown in FIG. 1.
Figure 4:
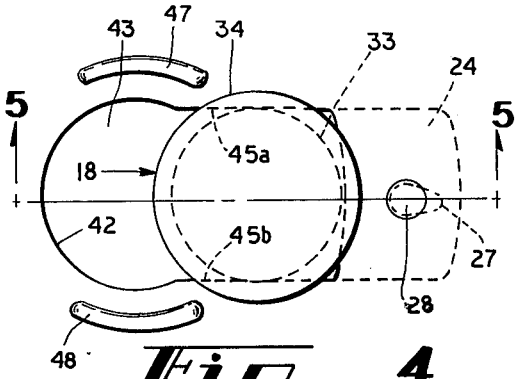
FIG. 4 is a top plan view of an opened container of the type shown in FIG. 1.

The openable member 18 is also provided with an opening tab in the form of a button 32 which, in the disclosed embodiment, is an integral part of the openable member and which is spaced a distance above the outside surface 14 of the end wall 12. The outermost extent of the button 32 preferably is below the chime 13, however, as best seen in FIG. 3. The outwardly-extended button 32 is defined by a peripheral wall 33 which is deformed from the nominal plane of the end wall 12 to extend outwardly a distance from the end wall; the button is further formed and defined by a flange 34 which, in the embodiment of FIGS. 1–5, overhangs substantially the entire arcuate score line segment 19'. The overhanging relation of the flange 34 and the score line segment 19' is best shown in FIGS. 2 and 3. The top of the button 32 is domed inwardly at 35 to provide a convenient recess for receiving the finger or thumb of a person opening the container. The wall 33 is necked inwardly from the score line to form a channel which allows the openable member 18, when separated from the end wall 12, to be moved with respect to the end wall.

A detailed view of the scoring used for the embodiments of FIGS. 1–5 is shown in FIG. 3A, showing that the score line 19' (as well as at 19) has an assymmetrical cross-section. One side 38 of the score 19' is substantially perpendicular to the outside surface 14 of the end wall, while the other side 39 of the score is diagonally inclined from the outside surface to form an acute angle with the vertical side 38. The purpose of the particular depicted scoring is made apparent below, although it will become apparent that alternative scoring techniques may be employed. Those skilled in the art will recognize that the type of scoring shown in FIG. 3A is sometimes known as the "Alcoa B-48" score, wherein the diagonal side 39 and the perpendicular side 38 meet at an included angle in the order of 45°.

The operation of the embodiment described in FIGS. 1–5 is now discussed. A person desiring to open the container 10 must press downwardly with a thumb or finger on the domed region 35 of the button 32, and this downward pressure exerts a force on the score line 19 (including the segment 19') which causes the score line to rupture; the openable member 18 thus becomes separated from the end wall 12. Rupturing of the score line 19 in the disclosed embodiment is enhanced by the off-center location of the button 32, relative to the longitudinal extent of the openable member 18 as viewed in FIG. 3. When the off-center button 32 is pressed inwardly toward the end wall 12, the force applied to the button is unevenly distributed throughout the score line 19, and concentrations of force-induced stress will occur at one or more locations along the score line. The score line initially ruptures at a point or points of stress concentration, and the resulting initial rupture allows the openable member 18 to undergo a degree of inward movement, relative to the end wall 12, which produces more stress and causes the remainder of the score line 19 to become ruptured.

Figure 5:
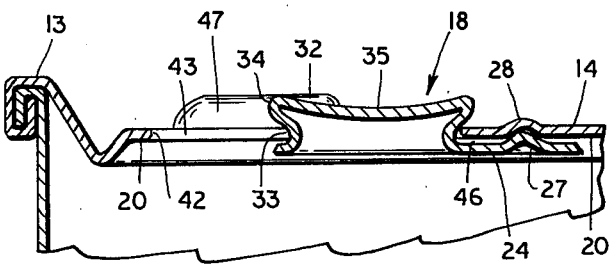
FIG. 5 is a section view taken along line 5—5 of FIG. 4.
Figure 5A:
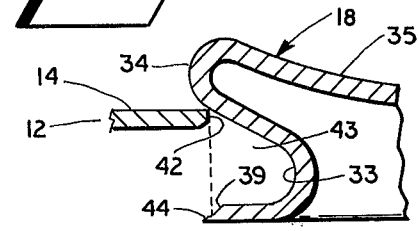
FIG. 5A is an enlarged fragmentary view of the score line of FIG. 3A, immediately after becoming separated.

As soon as the score line 19 is ruptured, the openable member 18 can move inwardly toward the outside surface 14. However, the extent of inward movement is limited by the flange 34, which overhangs the score line segment 19' and which has moved into contact with the outside surface 14 surrounding the peripheral edge 42. This contact is best seen in FIG. 5A. Since the opener's finger was placed on the domed area 35 to press the button 32 downwardly, it is apparent that the finger cannot inadvertently enter the opening 43 in the end wall 12 at this time and, indeed, cannot even contact the roughened peripheral edge 42 which is presently beneath the overhanging flange 34.

It is also apparent from FIG. 5A that the diagonal side 39 of the score 19 became ruptured along a surface 44 which is substantially a continuation of the diagonal surface, with the result that the surface 44 underhangs the peripheral edge 42 of the opening 43 to an extent which prevents the openable member 18 from being completely detached from the end wall 12 by pulling the opening structure outwardly through the opening. As a result, the openable member 18, although now separated from the end wall 12, remains captivated by the end wall.

The opening procedure is completed by sliding the openable member a distance to the right (as viewed in FIGS. 4 and 5) so that the openable member becomes displaced from a portion of the opening 43. This displacement occurs as the tab section 24 slides beneath the end wall 12, with the locking detent 17 being moved into detent engagement with the locking dimple 28 as shown in FIG. 5. Opening of the container 10 is now completed, and the contents of the container may be poured or consumed directly from the container opening 43 in the manner known to those skilled in the art.

The longitudinal sliding of the openable member 18 is facilitated by the closely-spaced sliding connection between the channel provided by the necked peripheral wall 33 of the openable member, and the spaced-apart peripheral edges 45*a* and 45*b* which remain when the sides 25*a* and 25*b*of the tab 24 became separated from the end wall 12. The spacing between the two sides 45*a* and 45*b*, relative to the corresponding distance across the necked peripheral wall 33, must be sufficient to allow the aforementioned longitudinal sliding movement without being so large as to permit the openable member 18 either to be withdrawn completely from the end wall 12, or to fall through the opening 43 into the interior of the container 10. The spacing between the sides 45*a* and 45*b* is slightly reduced from the maximum diameter of the arcuate of the score line segment 19', as best shown in FIG. 2, to facilitate retention of the opening structure 17.

The height of the locking detent 27, relative to the depth of the locking dimple 28 in the inside surface 20, causes the tab section 24 to be disposed downwardly a distance below the inside surface as shown in FIG. 5, so that a space 46 is provided between the inside surface of the end wall and the tab section to vent air into the container 10 as the contents of the container are being poured or consumed through the opening 423.

Reviewing the operation of the embodiment shown in FIGS. 1–5, the openable member 18 has been separated from its previous integral relation with the end wall 12 and has been moved longitudinally of the end wall to be locked in an opened position allowing access to the contents of the container. The openable member 18 remains captivated on the end wall 12 of the container, however, and the openable member cannot fall into the interior of the container. The flange 34 prevents the button 32 and the user's finger from coming into engagement with the peripheral edge 42 of the opening 4 in the container, and the presence of the flanged button 32 provides psychological as well as actual assurance that the container can be manually opened with no risk of personal injury.

It may be desired to form the smile beads 47 and 48 on either side of the button 32, to prevent the openable member 18 from becoming inadvertently opened when a number of the containers 10 are being vertically stacked. The smile beads 47 and 48 should preferably extend outwardly from the outside surface 14 of the end wall 12 to extend just beyond the outermost extent of the button 32. The smile beads 47 and 48 may also have a desirable stiffening effect on the end wall 12 surrounding the openable member, although in some applications it may be desirable to forego the smile beads.

Figure 6:
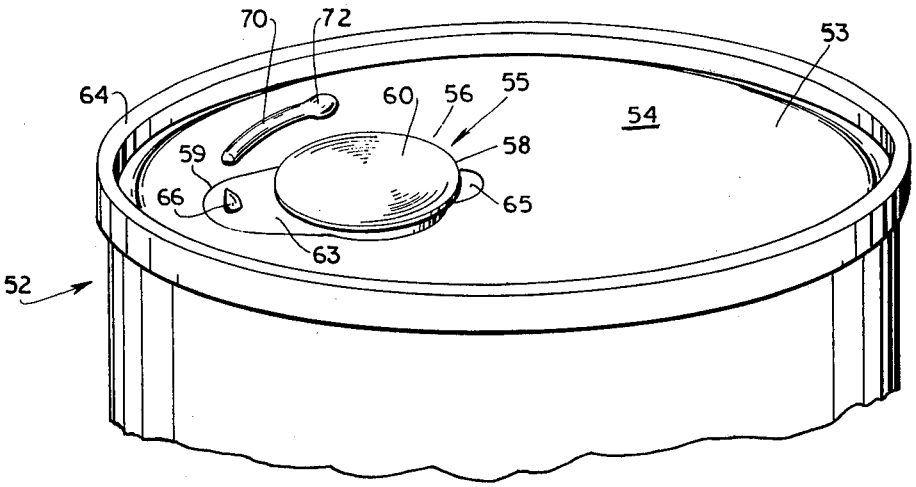
FIG. 6 is a fragmentary pictorial view of a container provided with easy-open structure according to another disclosed embodiment of the present invention.
Figure 7:
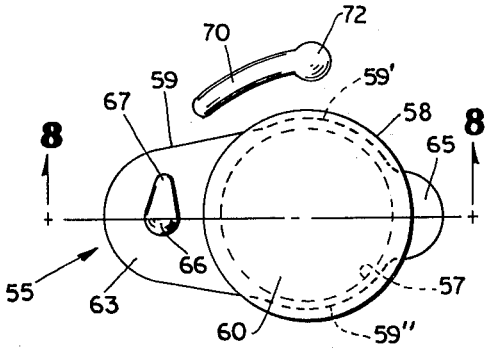
FIG. 7 is a top plan view of the embodiment shown in FIG. 6.

The embodiment of the present invention shown in FIGS. 6–11 has an openable member which is rotatable to expose the opening into the container, rather than sliding as in the previously-described embodiment. Turning to FIG. 6, there is shown a container indicated generally at 52 and including an end wall 53 having an outside surface 54. An openable member indicated generally at 55 is defined in the end wall 53 by the score line 59, and the openable member is preferably integral with the end wall in a manner similar to the previous embodiment. The openable member includes an opening tab in the form of a button 56 which extends a distance outwardly from the outside surface 54 of the end wall 53, with the button 56 being formed above and integrally with the necked channel provided by the annular peripheral wall 57. A flange 58 is formed on the button 56 surrounding and spaced outwardly from the peripheral wall 57, and it is apparent in FIG. 7 that the flange 58 overhangs curvilinear segments 59' and 59'' of the score line 59 which defines the openable member 55 in the end wall 53. An inwardly-domed depression 60 in the button 32 provides a finger-receiving area.

The openable member 55 has a first tab section 63 which extends from the button 56 a distance toward the chime 64 of the container 52. The openable member 55 also has a second tab section 65 which extends from the button 56 a distance toward the center of the end wall 53. A locking detent 66 is formed in the first tab section 63 to extend a distance outwardly from the outside surface 54 of the end wall 53, and it can be seen from FIG. 7 that the locking detent 66 may have a narrow end 67 directed approximately at right angles to the longitudinal axis defined by the tab section 63 and the button 56.

A locking track 70 is formed in the end wall 53 to extend upwardly from the inside surface 71 of the end wall. The locking track 70 is arc-shaped and is situated on the end wall 53 to receive the locking detent 66 when the openable member 55 is separated from the end wall 53 and rotated, as described below. The locking track 70 has an enlarged area 72 at one end, to receive and retain the locking detent 66.

The operation of the embodiment shown in FIGS. 6–11 is now described. The openable member 55 is initially separated from the end wall 53 in substantially the same manner as previously described, namely, by pressing downwardly on the domed depression 60 with finger or thumb. The resulting inwardly-directed force applies stress to rupture the score line 59, so that the openable member 55 becomes separated from the remainder of the end wall 53 and moves inwardly toward the end wall 53. The flange 58 contacts the overhung portions of the outside surface 54 which are adjacent the former score segments 59' and 59'', thereby preventing the button from entering the opening 73 in the end wall.

Figure 9:
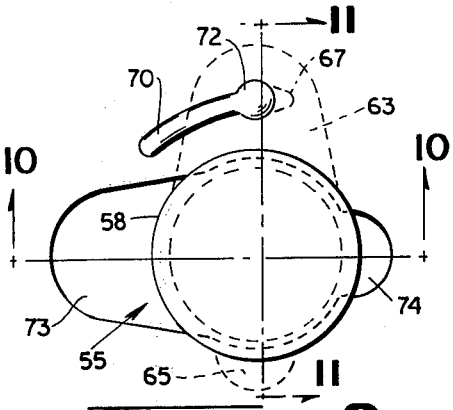
FIG. 9 is a top plan view showing the embodiment of FIG. 6 in opened position.
Figure 8:
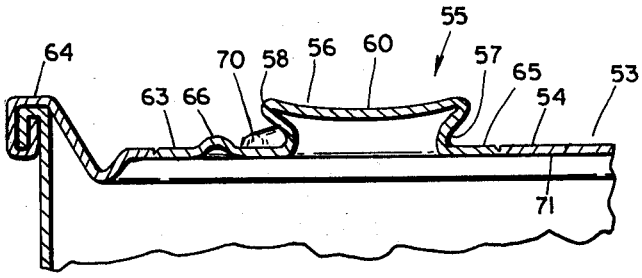
FIG. 8 is a section view taken along line 8—8 of FIG. 7.
Figure 11:
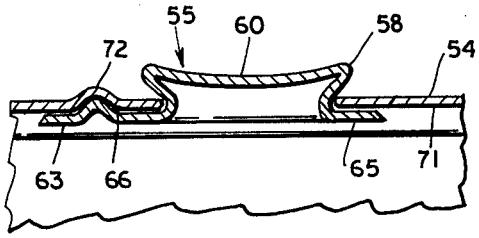
FIG. 11 is a section view taken along line 11—11 of FIG. 9.
Figure 10:
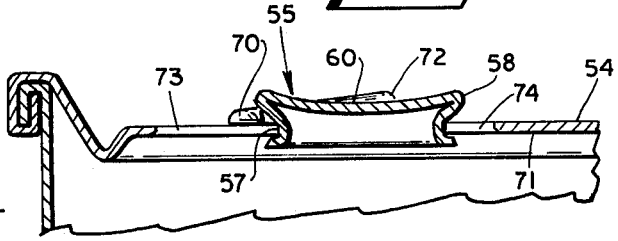
FIG. 10 is a section view taken along line 10—10 of FIG. 9.
Figure 12:
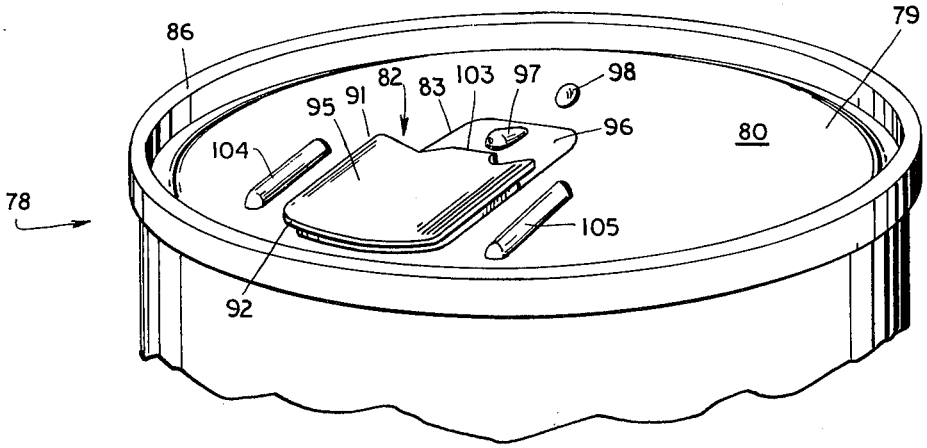
FIG. 12 is a fragmentary pictorial view of a container provided with easy-open end structure according to still another disclosed embodiment of the present invention.
Figure 13:
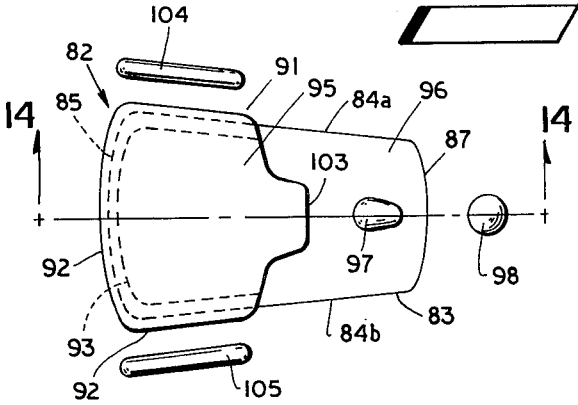
FIG. 13 is a top plan view of the embodiment shown in FIG. 12.

The button 56 is now grasped by the flange 58 and the openable member 55 is rotated clockwise approximately 90° to the position shown in broken lines in FIG. 9, so that the first tab section 63 and the second tab section 65 are disposed beneath the end wall 63 of the container 52. The necked channel provided by the peripheral wall 57 allows the openable member 55 to be rotatably received within the confronting curvilinear edges provided by the former score segments 59' and 59''. Such rotation of the openable member 55 moves the locking detent 60 along the inside surface 71 of the end wall 53 to enter and move along the locking track 70, until the locking detent enters and is retained in the enlarged area 72 at the end of the locking track.

Opening of the container 52 is now completed, and a pair of openings 73 and 74 remain in the end wall 53 by separation and displacement of the respective tab sections 63 and 65. The larger opening 73, being closer to the chime 64 of the container 52, provides a drinking or pouring opening while the opening 74 provides an air vent into the container. As with the embodiment described in FIGS. 1–5, the openable member 55 cannot enter the container 52 and the flange 58 protects fingers from inadvertently contacting the peripheral edges of the openings while the button 56 is being forced downwardly to sever the score line 59. The embodiment of FIGS. 6–11 can also be provided with the score structure shown in FIGS. 3A and 5A, if desired, to captivate the openable member 55 onto the end wall 53.

Still another disclosed embodiment of the present invention is shown in FIGS. 12–16, wherein the container shown generally at 78 has an end wall 79 with an outside surface 80 on which is disposed an openable member indicated generally at 82. Although the openable member 82, which is defined by an uninterrupted score line 83, becomes completely detached from the end wall 79 during opening and thereafter slides toward the center of the end wall, as does the embodiment shown in FIGS. 1–5, the openable member 82 of the presently-discussed embodiment has no curvilinear or arcuate portions. Instead, the openable member 82 is defined by score line portions 84*a* and 84*b* which taper inwardly from a relatively wide end score line 85, positioned adjacent the chime 86 of the container, to the relatively narrow inner end score line portion 87, which is positioned toward the center of the end wall 79. The score line portions 84*a* and 84*b*, accordingly, form a wedge-shaped pair of nonparallel score line segments which converge toward the inner segment 87 of the score line.

Figure 14:
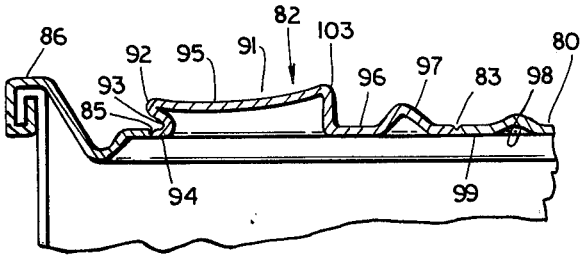
FIG. 14 is a section view taken along line 14—14 of FIG. 13.

A button 91 forms an opening tab which is integrally formed on the openable member 82 at the end nearest the wide score line portion 85, with the button 91 being raised above the outside surface 80 of the end wall 79. As best shown in FIG. 14, the button 91 has a peripheral flange 92 which is spaced above the outside surface 80 and which overhangs the end score portion 85, as well as parts of the side score line portions 84*a* and 84*b*.

The button 91 is necked inwardly beneath the flange 92, as shown at 93, to define a sliding channel located between the flange and the segment 94 of the openable member which extends forwardly to the score line 83.

An inward concave area 95 is provided on the top of the button 91 to receive finger or thumb pressure during opening. As particularly shown in FIG. 14, the concave area 95 may be skewed somewhat toward the forward score line portion 85 to provide an even more unequal distribution of stress on the score line 83 when the button 91 is pressed downwardly.

Extending from the button 91 toward the center of the end wall 79 is the tab portion 96, which is bounded by the side score line portions 84*a* and 84*b* and the end score line portion 87. A locking detent 97 extends outwardly from the outer surface of the tab portion 96, and a mating locking dimple 98 is formed in the inside surface 99 of the end wall 79. A stop member 103 is formed on the rear of the button 91, facing toward the center of the end member 79, with the stop member extending above the outside surface of the tab portion 96 at a predetermined location relative to the tab portion.

A pair of smile beads 104 and 105 may be formed in the end wall 79 in opposed flanking relation alongside the button 91. The smile beads 104 and 105, if provided, preferably extend upwardly from the outside surface 80 sufficiently to extend just above the outermost point of the button 91, so that the openable member 82 is protected from inadvertent opening when containers are vertically stacked.

The opening operation of the embodiment shown in FIGS. 12–16 is now discussed. Opening is initiated substantially in the manner discussed above with the previous embodiments, with the entire score line 83 being ruptured by downward pressure applied to the concave area 95 of the button 91. After the score line is ruptured, the entire openable member 82 moves downwardly until the overhanging flange 92 contacts the area of the outside surface 80 which surrounds the score line side portions 84*a* and 84*b*, as well as the front end score line portion 85, thus preventing further movement of the openable member into the container. The tab portion 96 is now below the inside surface 99 of the end wall 79, and the openable member 82 is free to be moved back toward the center of the end wall to expose the opening 106 into the container.

Figure 16:
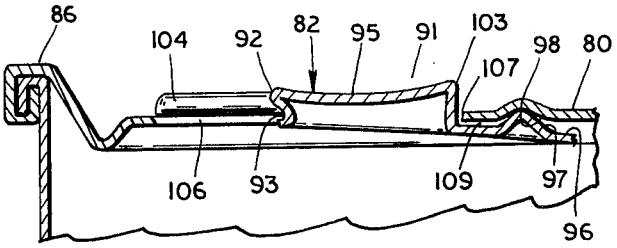
FIG. 16 is a section view taken along line 16—16 of FIG. 15.

The openable member 82 is moved back until the locking detent 97 is received in the locking dimple 98, as shown in FIG. 16, to retain the openable member in the full-open position. The stop member 103 is positioned to be in substantial abutting contact with the innermost edge 107 of the opening 106 when the openable member is fully open. The areas 108*a* and 108*b* of the tap portion 96 are now in air vent communication into the container 78 through the space 109 (FIG. 16) maintained between the inside surface 99 of the end wall 79 and the tap portion by contact of the locking detent 97 within the dimple 98.

Figure 15:
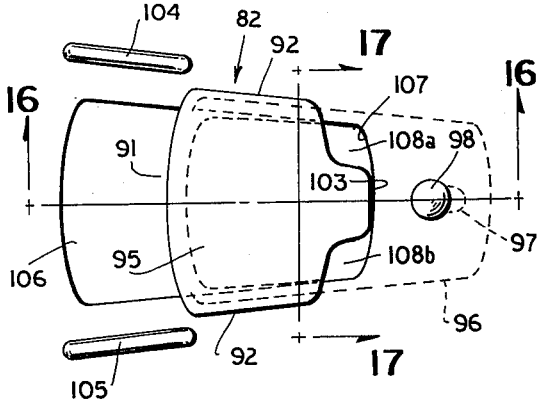
FIG. 15 is a top plan view of the embodiment shown in FIG. 12, in fully-opened position.
Figure 17:
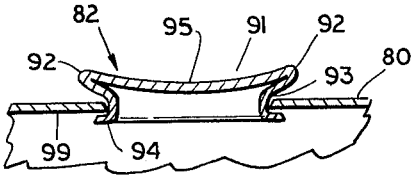
FIG. 17 is a section view taken along line 17—17 of FIG. 15.

As seen in FIGS. 15 and 17, the backward sliding movement of the separated openable member 82 causes the inwardly-necked channel 93 of the button 91 to become received even more positively between the confronting peripheral edges of the opening 106 in the end wall 79. This interlocking relation between the channel 93 and the end wall of the container further ensures that the openable member 82 cannot become detached from the end wall after opening. The embodiment of FIGS. 12–17 can be provided with the inwardly-beveled score construction previously described with respect to FIGS. 3A and 5A, to provide further assurance that the opening structure 81 will remain captivated to the end wall 79 of the container.

Figure 18:
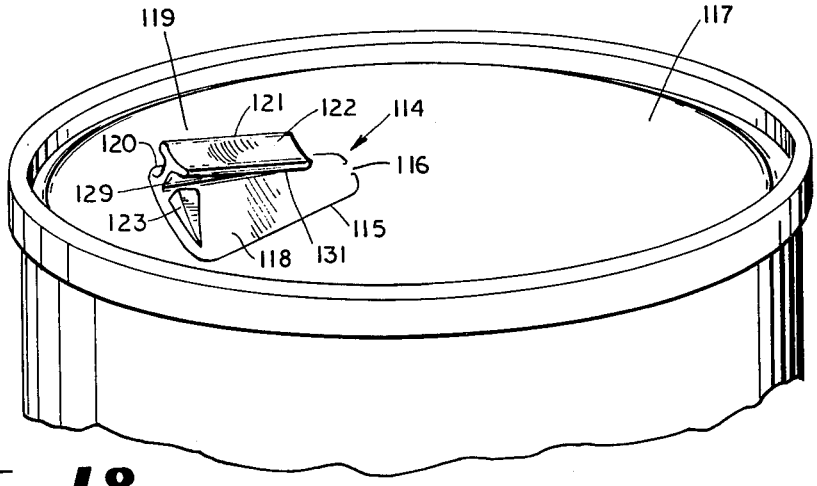
FIG. 18 is a fragmentary pictorial view of a container provided with easy-opening end structure according to yet another disclosed embodiment of the present invention.
Figure 19:
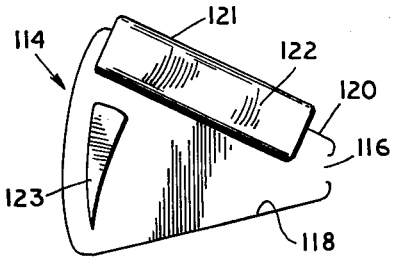
FIG. 19 is a top plan view of the embodiment shown in FIG. 18.
Figure 20:
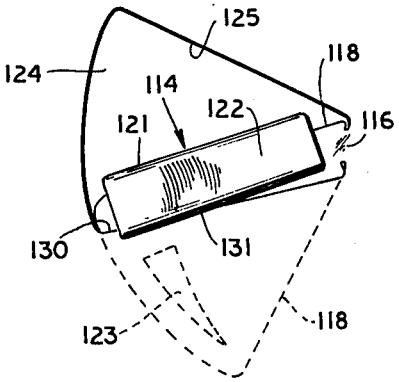
FIG. 20 is a top plan view of the embodiment shown in FIG. 18, in opened position.

Although the above-described embodiments of the present invention utilize an openable member which is defined by an uninterrupted score line, so that the openable member becomes completely separated from the wall of the container upon opening, the embodiment shown in FIGS. 18–20 utilizes an openable member indicated generally at 114 and defined by a score line 115 which is interrupted at 116 by unweakened end wall material so that the openable member remains attached to the end wall 117 when the score line 115 becomes ruptured.

The openable member 114, as defined on the end wall 117 by the score line 115, includes a tab 118 of approximately sector shape, as best seen in FIG. 19. A button 119 forms an opening tab which extends upwardly along one side 120 of the tab 118, with the button having a flange 121 which overhangs the end wall adjacent the side 120. A generally concave depression 112 is formed along the top surface of the button 109 to receive finger or thumb pressure. A wedge-shaped detent 123 extends outwardly from the outside surface of the tab 118.

Opening of the embodiment shown in FIGS. 18–20 is initiated by pressing downwardly on the button 119, whereupon the score line 115 becomes severed and the openable member 114 moves downwardly until the flange 121 contacts the end wall 117 adjacent the edge 125 of the opening 124. The openable member 114 remains attached to the end wall 117 by the interrupted portion 116, which does not become ruptured with the score line. The openable member 117 is now pivoted around a hinge provided by the interrupted portion 116 to slide the tab 118 beneath the end wall 117, as shown by broken line in FIG. 20, so that the opening 124 into the container is exposed. The interrupted portion 116 should be sufficiently flexible to permit the foregoing pivotal movement of the openable member 114. The side 129 of the button 119 provides a motion stop which engages the edge 130 of the opening 124 when the opening structure 114 is in fully-open position, and a second overhanging flange 131 may be provided on the button 119 to overhang the side 129 and prevent the button (and the finger of a user) from being inadvertently pressed downwardly into contact with the sharp edge 130. The raised detent 123 maintains the tab 118 spaced apart from the underside of the end wall 117, for venting purposes.

Figure 21:
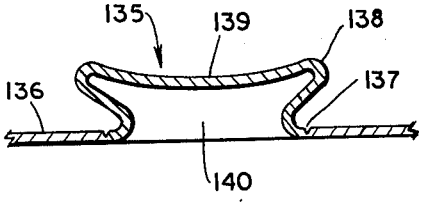
FIG. 21 shows a fragmentary vertical section view of easy-open structure which is detachable from the container wall, according to an alternative disclosed embodiment of the present invention.
Figure 28:
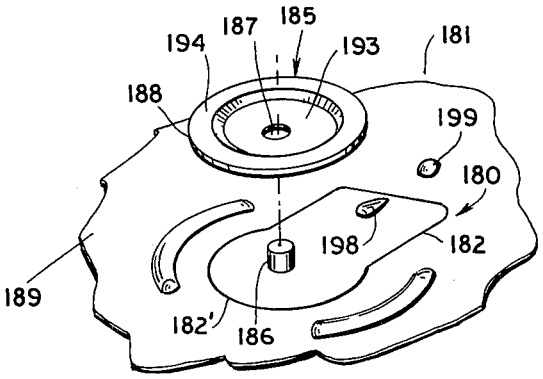
FIG. 28 is a fragmentary exploded pictorial view of easy-open end structure according to another disclosed embodiment of the present invention, showing the opening tab as a separately-formed member which is attached to the openable member.

FIG. 21 shows an alternative embodiment of the present invention which, unlike the embodiments described above, has an openable member 135 which is intended for complete detachment and removal from the container wall 136. The openable member 135 is formed integrally with the wall 136, as described above, and is preferably defined in the wall by a score line 137 which is a conventional V-cut score, or the functional equivalent, lacking the diagonal retaining feature discussed above with respect to FIGS. 3A and 5A.

The openable member 135 is preferably in the shape of a button having a peripheral flange 138 which overhangs the score line 137, and having an interior depression 139 for receiving thumb or finger pressure. The depression 139 may be skewed slightly toward one edge of the button to provide assymmetrical application of stress to the score line 137. Once the score line 137 is ruptured by downward pressure applied to the button, the entire openable member 135 is grasped and removed from the container. The resulting opening 140 remains in the container wall 136. The overhaning flange 138 prevents the openable member from being pushed through the opening 140.

Figure 22:
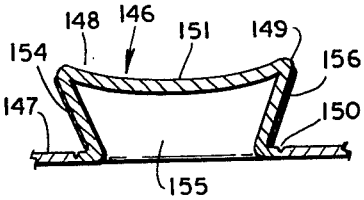
FIG. 22 shows a vertical section view of easy-open structure having reclosure capability, according to another alternative disclosed embodiment of the present invention.
Figure 23:
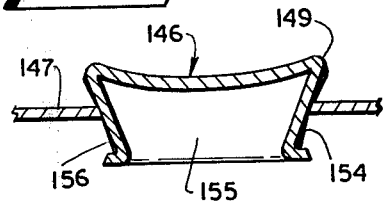
FIG. 23 is a vertical section view of the embodiment shown in FIG. 22, with the opening in the container wall being reclosed by the separated opening member.

FIGS. 22 and 23 show a modified embodiment of a fully-removable openable member 146, which is additionally capable of resealing the opening 155 which remains in the container wall 147 when the openable member is removed. The openable member 146 includes a button 148 extending upwardly from the wall 147 and having a peripheral flange 149 which overhangs the score line 150 in the container wall. A depression 151 is formed within the button 148 for opening purposes. The button 148 and the score line 150 may both be round, in the present embodiment, and the button has a peripheral surface 154 in the shape of a truncated cone extending between the flange 149 and an inner location adjacent to the score line.

The openable member 146 is separated from the container wall 147 by pressing downwardly against the depressed region 151 of the button to rupture the score line 150. The openable member 146 may thereafter be completely withdrawn from the opening 155 in the container wall 147, if desired. The openable member 146 may be returned to the opening 155 and forced downwardly until the conical peripheral surface 154 of the opening structure becomes wedged against the periphery of the opening 155, as shown in FIG. 23, to effectively reseal the container. The peripheral surface 154 may be coated with a sealant material 156 such as an elastomeric substance or the like suitable for promoting an air-tight seal, if desired, when the opening structure is used to reseal the container as shown in FIG. 23.

Figure 24:
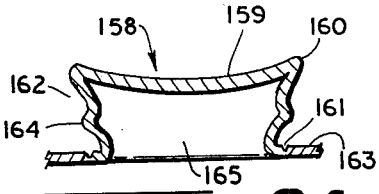
FIG. 24 shows a vertical section view of another disclosed reclosure embodiment of the present invention.
Figure 25:
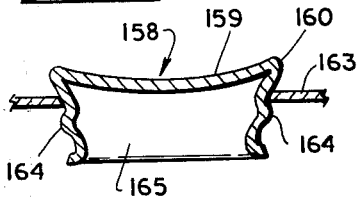
FIG. 25 is a vertical section view of the embodiment shown in FIG. 24, with the opening in the container wall being reclosed by the separated opening member.

Alternative reclosure apparatus is shown in FIGS. 24 and 25, in which the openable member 158 includes a button 159 having a peripheral flange 160 which overhangs the score line 161, all in a manner as previously described. The button 159 includes a peripheral side wall 162 extending upwardly from the container wall 163 to the flange 160, and a periperal bead 164 is formed to project outwardly around at least portions of the side wall 162. Both the uninterrupted score line 161 and the bead 164 may be circular.

When the openable member 158 is separated from the container wall 163 by inward pressure which ruptures the score line 161, the openable member may thereafter be forced downwardly through the resulting opening 165 in the container wall until the bead 164, which is slightly larger than the opening, snaps through the opening and assumes a position shown in FIG. 25. The bead 164 retains the openable member 158 is reclosure position until the opening structure is removed by lifting the flange 160 upwardly to unsnap the bead 164 around the periphery of the opening 165. The side wall 162 may, if desired, be coated with a sealant material to provide an airtight reclosure capability.

Figure 26:
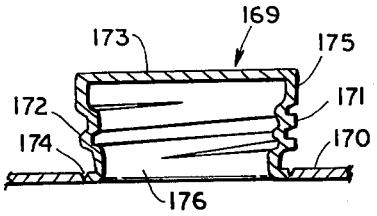
FIG. 26 is a vertical section view of still another disclosed reclosable embodiment of the present invention.
Figure 27:
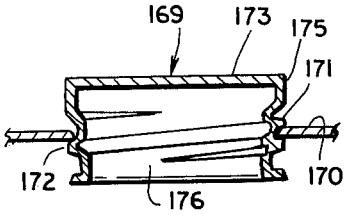
FIG. 27 is a vertical section view of the embodiment shown in FIG. 26, with the opening in the container wall being reclosed by the separated opening member.

FIGS. 26 and 27 show still another reclosable embodiment of the present invention, in which the openable member 169 formed integrally with the container wall 170 has threads 171 rolled or otherwise formed in the peripheral side 172 of the openable member between the button 173 and the circular score line 174. An overhanging flange 175 of greater diameter than the opening 176 is provided on the button 173 to prevent the openable member 169 from completely entering the container.

When the button 173 is pressed downwardly to rupture the score line 174, the button 173 can thereafter be rotated to screw the openable member 169 into the periphery of the opening 176 formed in the container wall 170, as shown in FIG. 27. The threads 171 may be coated with sealant to provide an airtight reclosure seal. When it is desired to open the container, the button 173 is simply unthreaded and the openable member 169 is removed from the opening 176.

Although the above-described embodiments of the present invention have an opening tab formed as an integral unitary part of the openable member which is defined in the container wall by a score line, the following embodiments of the invention illustrate that the opening tab can alternatively be a separate element which is attached to an openable member defined in the container wall by a score line.

Turning to the embodiment of the present invention shown in FIGS. 28–33, for example, the openable member 180 is defined by the score line 182 in the end wall 181 of a container; the score line may be a type which, when ruptured, prevents the openable member from being detached from the end member, such as the score line previously discussed with respect to FIGS. 3A and 5A. The openable member 180 includes an arcuate portion defined by the score line segment 182′, which is curvilinear and extends over slightly more than 180° to join with the tab section 183 extending along the end wall 181 away from the curvilinear portion of the openable member. The outline of the openable member 180 defined on the end wall 181 by the score line 182 is substantially similar to the outline of the corresponding openable member 18 formed on the end wall 12 of the embodiment shown in FIGS. 1–5.

A separate opening tab 185 is attached to the openable member 180 by suitable means such as the rivet 186 or the like. The rivet 186, after being integrally formed in the openable member 180, is disposed through the opening 187 in the separately-formed opening tab 185 and is then deformed to provide the rivet head 186′ (FIGS. 30 and 32), so that the opening tab is permanently secured to the openable member.

Figure 30:
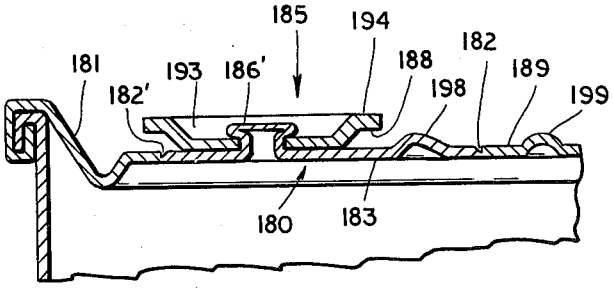
FIG. 30 is a section view taken along line 30—30 of FIG. 29.
Figure 29:
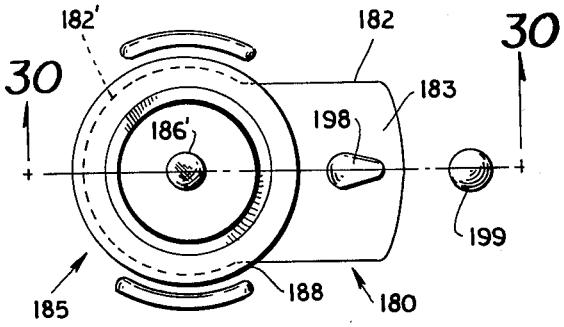
FIG. 29 is a top plan view of the assembled embodiment shown in FIG. 28.

As best seen in FIG. 30, the opening tab 185 is a circular disc having a peripheral flange 188 which corresponds to the flange 34 shown in FIGS. 1–5, and which overhangs substantially the entire arcuate score line segment 182'. The overhanging flange 188 is spaced outwardly a distance from the outside surface 189 of the end wall 181, and limits the extent to which the openable member-opening tab combination can move inwardly relative to the end wall 181 when opened.

The operation of the embodiment shown in FIGS. 28–33 is substantially similar to that discussed previously with respect to the embodiment of FIGS. 1–5. Finger pressure is applied downwardly onto the opening tab 185, either within the inner recess 193 provided within the opening tab or onto the annular outer surface 194 which surrounds the inner recess of the opening tab. The pressure applied to the opening tab 185 causes the score line 182 to become completely ruptured or otherwise separated, allowing the openable member 180 and the attached tab section 183 to move inwardly to an extend defined and limited by contact of the flange 188 with the peripheral edge 195 (FIG. 33) of the outer surface 189 which is overhung by the flange. The annular surface 194 of the opening tab 185 prevents a person's fingers from contacting the sharp or rough edge 196 which remains when the openable member 180 is displaced downwardly to provide the opening 197 in the end wall 181. If the score line 182 was of the type shown in FIGS. 3A and 5A, or if alternative structure retains the openable member within the opening 197, the separated openable member 180 and the attached opening tab 185 cannot be detached from the end wall 181.

Figure 32:
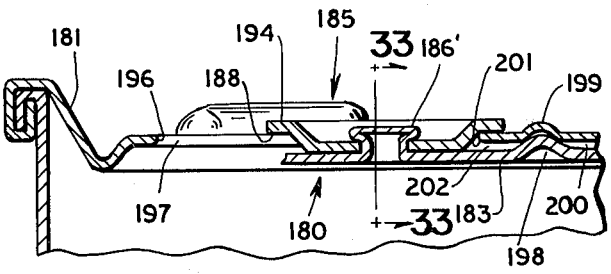
FIG. 32 is a section view taken along line 32—32 of FIG. 31.
Figure 31:
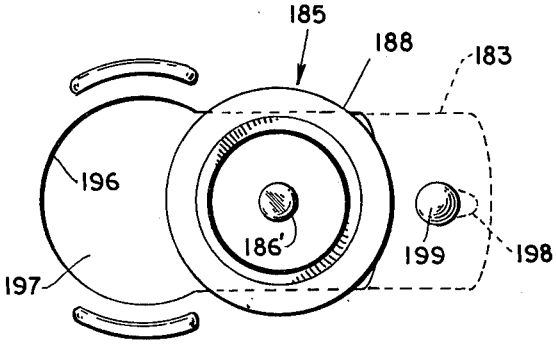
FIG. 31 is a top plan view showing the embodiment of FIG. 28 in opened position.
Figure 34:
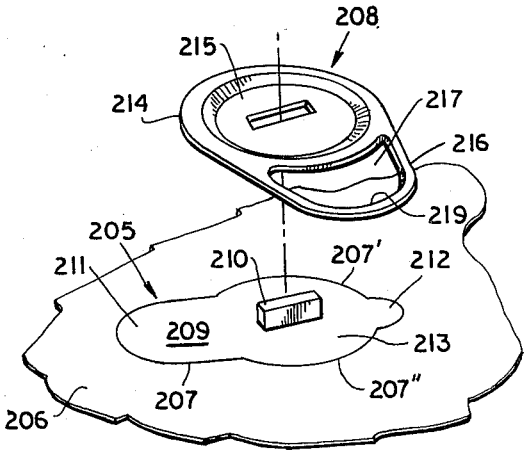
FIG. 34 is a fragmentary exploded pictorial view of easy-open end structure according to another disclosed embodiment of the present invention.
Figure 33:
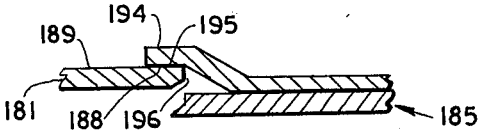
FIG. 33 is a section view taken along line 33—33 of FIG. 31.
Figure 35:
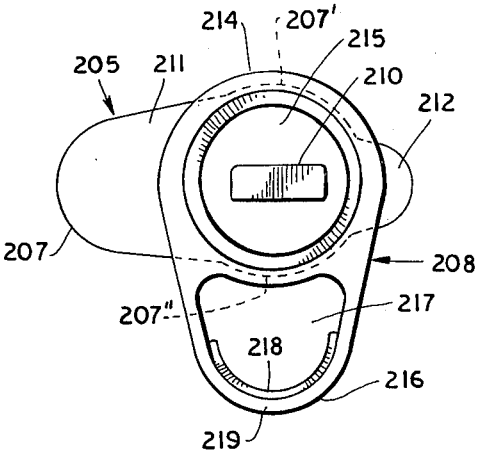
FIG. 35 is a top plan view of the assembled embodiment shown in FIG. 34.
Figure 36:
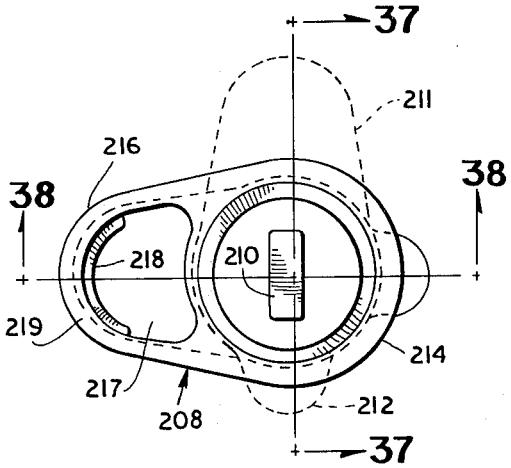
FIG. 36 is a top plan view showing the embodiment of FIG. 34 in opened position.

The opening procedure is completed by sliding the opening tab 185 to the right (as viewed in FIGS. 31 and 32) so that the tab section 183 slides beneath the end wall 181 until the locking detent 198 extending outwardly from the tab section becomes engaged with the locking dimple 199 extending into the inner surface 200 of the end wall. As best seen in FIG. 32, the edge 201 of the opening in the end wall 181 is received beneath the overhanging flange 188. The displaced tab section 183 is maintained in spaced-apart relation from the inner surface 200 of the end wall by engagement of the locking detent 198 with the locking dimple 199, leaving the intervening space 202 to provide an air vent into the now-opened container.

The embodiment shown in FIGS. 34–38 has an operable member 205 which is defined in an end wall 206 of a container by the score line 207 and which, upon separation of the score line, is rotatable in a manner similar to the previously-discussed embodiment shown in FIGS. 6–11. The openable member 205, however, has a separate opening tab 208 which is permanently affixed to the outer side 209 of the openable member by a fastening means such as the rectangular cross-section rivet 210 or the like. The score line 207 may be as shown in FIG. 3A.

The openable member 205 has an intermediate circular portion 213 which is defined by the spaced-apart circular segments 207' and 207'' of the score line 207. A first tab section 211 and a second tab section 212 extend in different directions outwardly from the circular score segments of the openable member 205. It is apparent that the openable member 205 of the embodiment depicted in FIGS. 34–38 is similar in shape to the area defined in the end member 53 by the score line 59, in the embodiment of FIGS. 6–11.

The opening tab 208 has a flange 214 which overhangs and is spaced outwardly from the score line portions 207' and 207'' and the opening tab may include an inwardly-dished recess 215 for conveniently receiving downwardly-directed pressure from a finger or thumb.

The opening tab 208 also includes an integral ring member 216 which defines a ring opening 217 surrounded at least partially by a downwardly-turned lip 218. The ring member 216 is angularly displaced from the first tab section 211, as particularly seen in FIGS. 35 and 36; while the extent of angular displacement between the ring member and the first tab section is not considered critical, the configuration and location of the ring opening 217 must allow the ring opening to be aligned with the opening left in the end wall 206 when the first tab section 211 is severed and displaced, as discussed below.

The embodiment shown in FIGS. 34–38 operates in the following manner. The score line 207 becomes separated in response to pressure applied downwardly to the opening tab 208, whereupon the openable member 205 and the attached opening tab move downwardly until the flange 214 contacts the overhung portions of the container end member 206. The opening tab 208 can now be rotated in a clockwise direction, as viewed in FIGS. 35 and 36, until the ring member 216 becomes aligned with the opening left in the end member 206 by displacement of the first tab section 211. The downwardly-extending protective lip 218 becomes disposed in the opening within the end member 206, as seen in FIG. 38, and the outwardly-facing surface 219 of the ring member forms a protective flange which surrounds and covers at least a portion of the rough edge 220.

Figure 37:
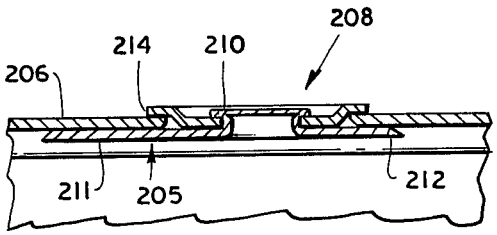
FIG. 37 is a section view taken along line 37—37 of FIG. 36.
Figure 38:
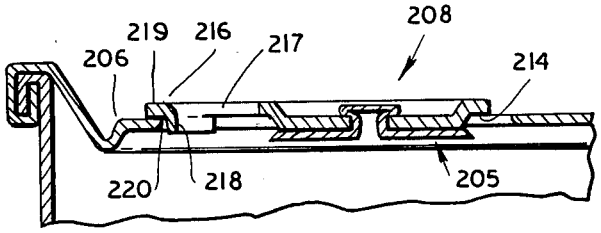
FIG. 38 is a section view taken along line 38—38 of FIG. 36.
Figure 39:
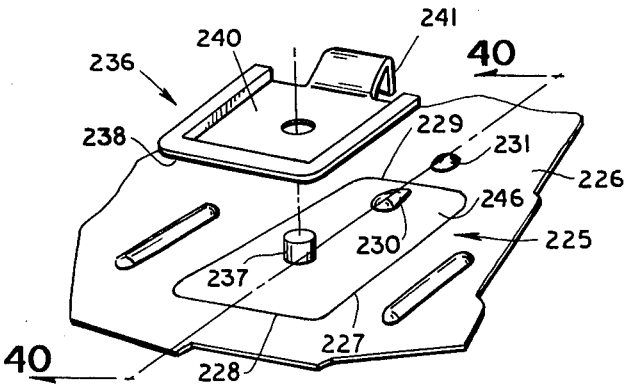
FIG. 39 is a pictorial view, in exploded form, of easy-open structure according to still another disclosed embodiment of the present invention.
Figure 40:
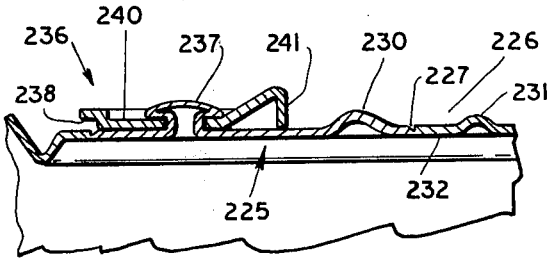
FIG. 40 is a section view taken along line 40—40 of FIG. 39, in assembled view.
Figure 41:
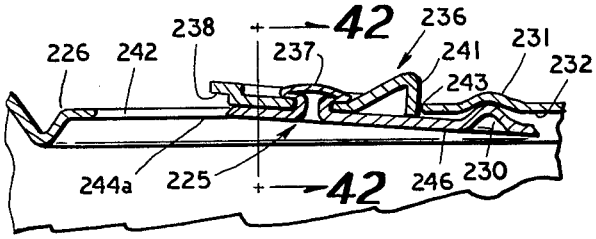
FIG. 41 is a section view taken along line 40—40, in opened configuration.
Figure 42:
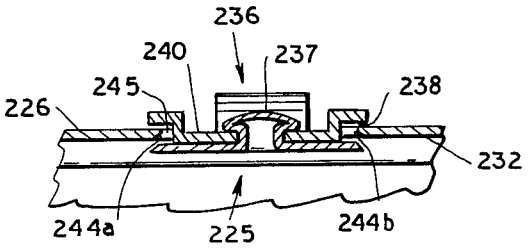
FIG 42 is a fragmentary section view taken along line 42—42 of FIG. 41.
Figure 43:
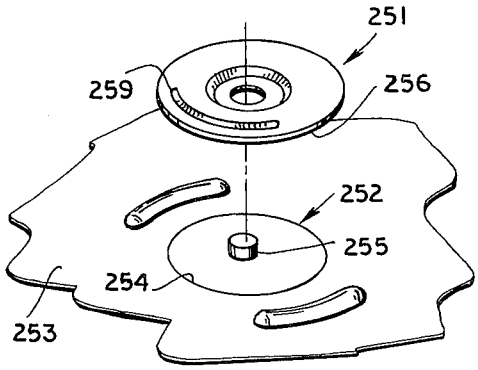
FIG. 43 is a pictorial view, in exploded form, of easy-open structure according to another disclosed embodiment of the present invention.

FIG. 37 shows that the flange 214 of the opening tab 208, along with the displaced tab sections 211 and 212 retains the fully-opened openable member 205 on the end wall 206.

Turning to the embodiment shown in FIGS. 39–42, an openable member 225 is defined in the end wall 226 of the container by the score line 227, which may provide a non-detachable openable member as described above with respect to FIGS. 3A and 5A. The openable member 225 tapers inwardly from a relatively wide end 228 to a relatively narrow inner end 229, so that the openable member 225 is similar in configuration to the openable member 82 defined in the end wall of the container embodiment shown in FIGS. 12–17. A locking detent 230 extends outwardly from the upper surface of the openable member 225, adjacent the narrow end 229 thereof, and a mating locking dimple 231 is formed in the inside surface 232 of the end wall 226.

A separate opening tab 236, which is secured to the openable member 225 by means such as the rivet 237, generally resembles the button 91 shown in FIGS. 12–17 and includes a peripheral flange 238 which overhangs the wide end 228 and side portions of the score line 227. The opening tab 236 can have an inward concave configuration as shown at 240, to receive finger or thumb pressure during opening, and has a stop member 241 formed on the rear of the openable member facing toward the narrow end 229.

To operate the embodiment shown in FIGS. 39–42, finger or thumb pressure is directed inwardly against the opening tab 236 to rupture the score line 229, so that the openable member 225 and the attached opening tab moves inwardly toward the end wall 226 until the flange 238 contacts the overhung portion of the end wall. The separated openable member may now be slidably displaced to the position seen in FIG. 41, to expose the opening 242 in the end wall. Opening sliding movement of the openable member 225 is limitd by contact of the stop member 241 with the innermost edge 243 of the opening formed by separation of the openable member, as well as by the potential wedging action of the inwardly-tapered sides 244*a* and 244*b* seen in FIG. 42. The overhanging flange 238 and the underlying retained portion of the openable member 225 define a channel 245 which guides the openable member and attached opening tab for sliding movement relative to the sides 244*a* and 244*b*.

When the openable member 225 is fully opened, the locking detent 230 engages the locking dimple 231 to retain the openable member in fully-opened position. The rearwardly extending portion 246 of the openable member is maintained spaced downwardly a distance from the inner surface 232 of the end wall 226, by the locking detent to provide an air vent channel into a container which is defined by the end wall 226.

The embodiment described in FIGS. 43–47 differs from the previously-described embodiments by having an opening tab 251 which substantially completely covers the underlying openable member 252 defined in a container end wall 253 by the uninterrupted score line 254, which is preferably of the type which provides a non-detachable openable member as previously described. The opening tab 251, which is attached to the openable member 252 by the integral rivet 255, includes a peripheral flange 256 which extends a distance outwardly from the end wall 253 and which overhangs the entire circumference of the circular score line 254. The rivet 255 attached to the center of the opening tab 251, although this location of the rivet is unimportant in the embodiment of FIGS. 43–47.

Figure 44:
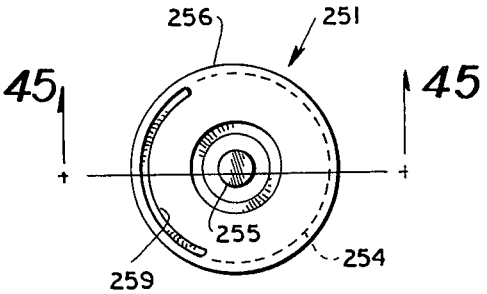
FIG. 44 is a top plan view of the embodiment shown in FIG. 43, in assembled form.

Extending downwardly from the underside of the opening tab 251 is a score break dimple 259, which contacts the end wall 253 at a location which will cause opening force to be exerted nonuniformly on the score line 254. The score break dimple 259, in the embodiment shown in FIG. 45, contacts the openable member 252 just inside the score line 254, and extends somewhat less than half-way around the arcuate extent of the openable member 252 as best seen in FIGS. 44 and 46.

Figure 45:
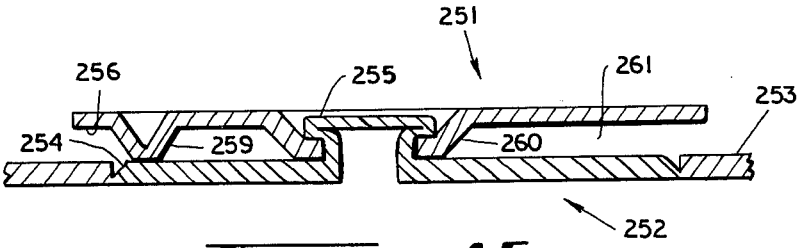
FIG. 45 is a section view taken along line 45—45 of FIG. 44.
Figure 45A:
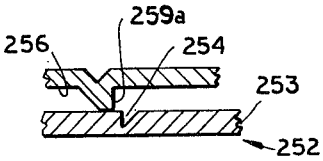
FIG. 45A is a fragmentary section view showning alternative placement of the score break dimple of FIG. 45.
Figure 45B:
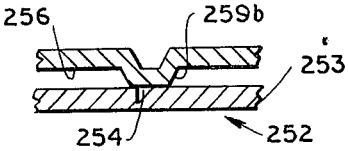
FIG. 45B is a fragmentary section view showing another alternative placement of the score break dimple of FIG. 45.
Figure 48:
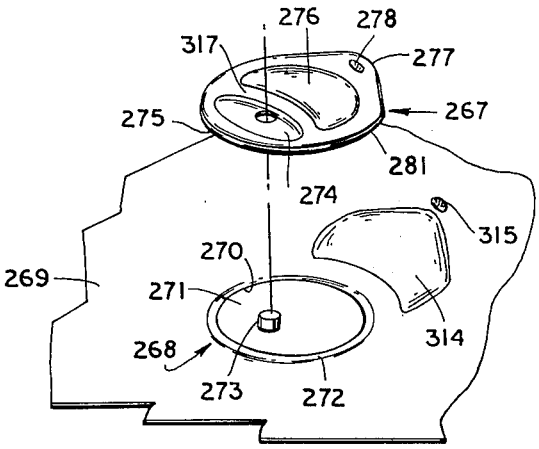
FIG. 48 is a pictorial view, in exploded form, of easy-open structure according to another disclosed embodiment of the present invention.
Figure 49:
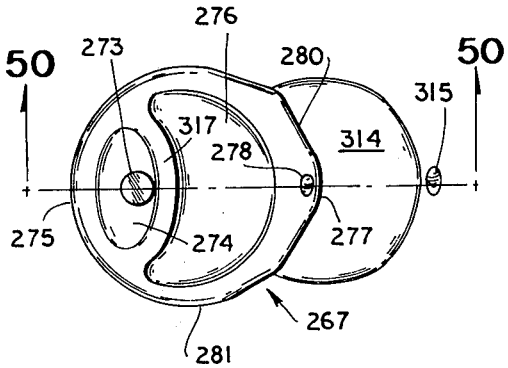
FIG. 49 is a top plan view, in assembled form, of the embodiment shown in FIG. 48.
Figure 50:
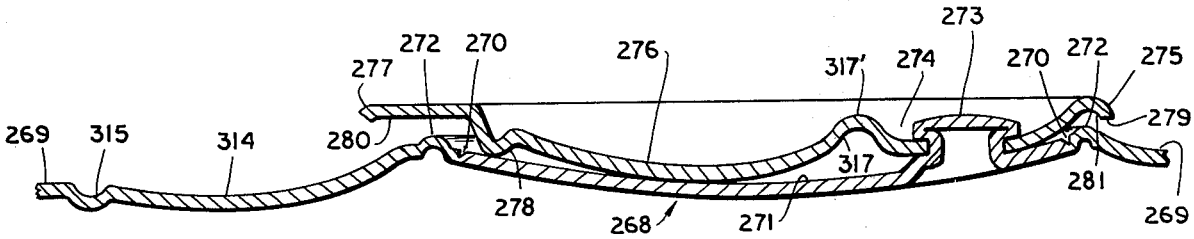
FIG. 50 is a section view taken along line 50—50 of FIG. 49.

FIG. 45A shows that the score break dimple can alternatively be positioned on the outside of the score line 254, as shown as 259*a*, while FIG. 45B shows that the score break dimple 259*b* can further alternatively be positioned directly on the score line 254. Whatever the location of the score break dimple, it is apparent from FIG. 45 that part of the flange 256 extends above the end wall 253 inwardly to a location 260, so as to define a channel 261 between the flange and the end wall.

Figure 46:
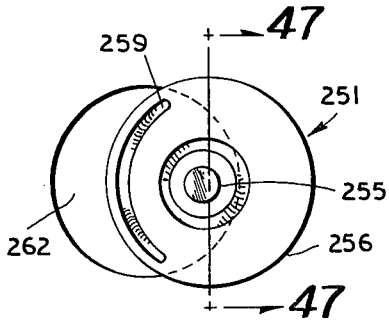
FIG. 46 is a top plan view showing the embodiment of FIG. 43 in opened position.
Figure 47:
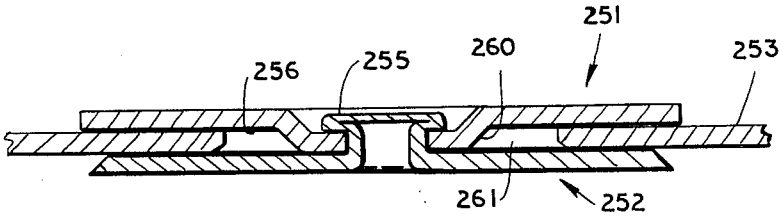
FIG. 47 is a section view along line 47—47 of FIG. 46.

Considering the operation of the embodiment shown in FIGS. 43–47, downward finger pressure is applied to the opening tab 251 and the force is nonuniformly applied to the score line 254 by the score break dimple 259 (or 259*a* or 259*b*), thereby rupturing the score line. The openable member 252 and attached opening tab 251 moves downwardly until the flange 256 contacts the overhung portion of the end wall 253. The openable member 252 and attached opening tab 251 can now be slidably displaced a distance to the right, as seen in FIG. 46, so that the end wall moves into the channel 261 as shown in FIG. 47. This sliding displacement of the openable member and opening tab exposes the opening 262 formed in the end wall 253 when the score line 254 became ruptured.

The embodiment shown in FIGS. 48–53 has an opening tab 267 which is substantially coextensive with the underlying openable member 268 formed in the end wall 269 by the score line 270. The openable member 268 defined by the score line 270 is dished downwardly as shown at 271 to extend beneath an imaginary plane containing the score line. Both the downwardly-dished openable member 268 and the score line 270 are surrounded by a bead 272 which lies just outside of the score line and which extends upwardly a short distance above the score line. The bead 272 provides a lip-protective rim surrounding the opening which remains in the end wall 269 upon opening and displacement of the openable member 268.

The opening tab 267 is secured to the openable member 268 by suitable means such as the rivet 273, which attaches to the opening tab at a recess 274 formed downwardly within the opening tab adjacent the forward end 275 thereof. The opening tab 267 is dished downwardly as shown at 276 to provide another recess which is located intermediate the forward end 275 and the rearward end 277 of the openable member, with the recess 276 extending downwardly to contact the dished area 271 of the underlying openable member 268 in the disclosed embodiment.

A score break detent 278 is provided which extends downwardly from the opening tab 267 into contact with the openable member 268 in close proximity to a location on the score line 272. The score break dimple 278, in the embodiment of FIGS. 48–53, is positioned to contact the opposite side of the openable member 268 from the location of the rivet 273.

The opening tab 267 is entirely surrounded by the flange 281, which overhangs and is spaced a distance outwardly from the score line 270. The outermost extent of the flange 281 turns downwardly, as shown at 279, so as to completely surround the score line 270 and to shield a person's fingers from injury during opening. The flange 281 is elongated as shown at 280, adjacent the rearward end 277 of the opening tab, to provide a spray deflector which is particularly useful in containers filled with carbonated or otherwise-pressurized beverages.

Disposed behind the opening tab 267 is a well 314 which extends downwardly from the outer surface of the end wall 269. The configuration of the well 314 is selected to conform with the underside configuration of the opening tab recess 276, which becomes disposed in the well 314 when the openable member is fully-opened. A locking dimple 315 is formed downwardly in the end wall 269 immediately behind the well 314.

The operation of the embodiment shown in FIGS. 48–53 is now considered. Opening is initiated by finger pressure downwardly on the opening tab 267, with such pressure typically although not necessarily being applied to the recess 276 in the opening tab. This downward force is transmitted to the underlying openable member 268 at three separate locations in the disclosed embodiment, namely, at the point of contact between the recess 276 and the downwardly-dished area 271, at or adjacent the rivet connection 273, and at the point where the score break dimple 278 contacts the openable member. The resulting force applied to the openable member causes an unequal distribution of stress within the score line 270, so that the score line becomes ruptured.

Figure 51:
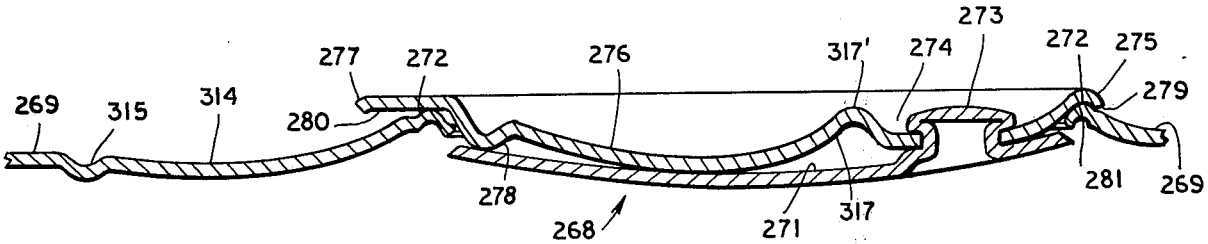
FIG. 51 is another section view taken along line 50—50, showing the openable member immediately after being initially broken away from the end member.

The openable member 268 and the attached opening tab 267 move downwardly to the position shown in FIG. 51, whereat the flange 281 contacts the bead 272. The opening tab 267 and the openable member 268 are slidably displaced rearwardly to assume the position shown in FIG. 52, and it can be seen that part of the end wall 269 has become disposed between the recess 276 of the opening tab and the downwardly-dished area 271 of the openable member. The score break dimple 278 is now disposed within the locking dimple 315, and the bead 272 situated at the rearward side of the opening 316 in the end wall 269 has become received within the channel 317 formed in the underside of the opening tab 267 by the rib 317' which separates the recesses 274 and 276.

Figure 52:
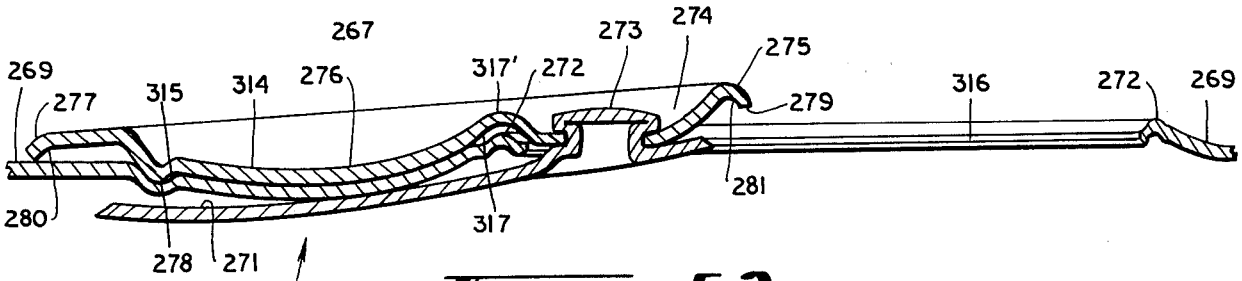
FIG. 52 is still another section view along line 50—50, showing the openable member in fully-opened position.
Figure 53:
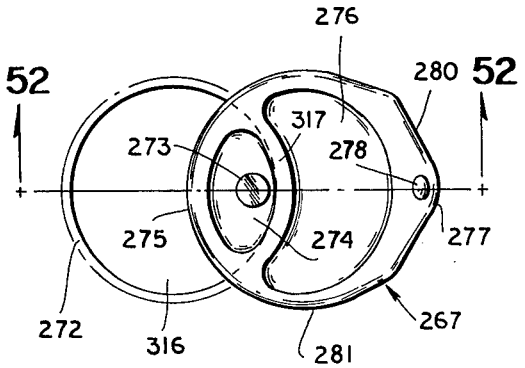
FIG. 53 is a top plan view of the embodiment of FIG. 48 in fully-opened position.

It is seen in FIG. 52 that the outermost extent of the flange 281, at the forward end 275 of the opening tab 267, is spaced upwardly and outwardly a distance from the end wall 269 in the open position. This opened position of the flange hinders or prevents a person from completely covering the opening 316 with his lips and mouth, so that air can vent into the container while beverages are consumed directly from the container.

The embodiment of the present invention shown in FIGS. 48–53 thus provides an openable member which is fully covered by an opening tab, and which is positively retained onto the end wall at all times. The closely surrounding fit between the flange 281, and the score line, thwarts deliberate attempts to detach the openable member-opening tab from the end wall by attempting to twist the openable member sideways within the opening 316.

Figure 54:
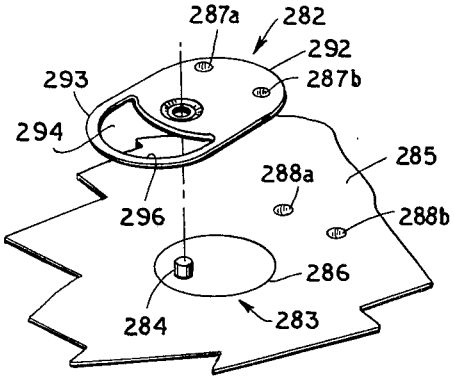
FIG. 54 is a pictorial view, in exploded form, of easy-open structure according to another disclosed embodiment of the present invention.
Figure 55:
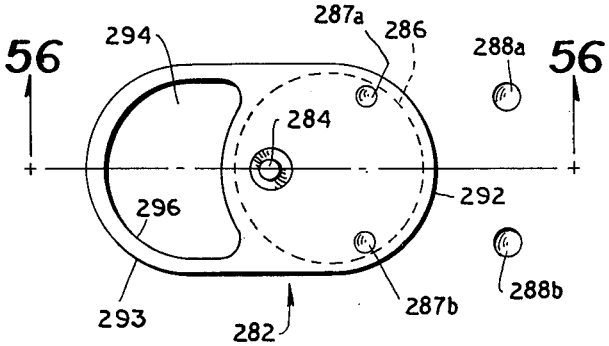
FIG. 55 is a top plan view, in assembled form, of the embodiment shown in FIG. 54.
Figure 56:
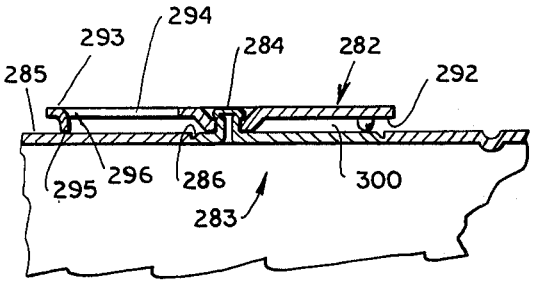
FIG. 56 is a section view taken along line 56—56 of FIG. 55.

The embodiment depicted in FIGS. 54–57 has an opening tab 282 which is connected by the rivet 284 to an openable member 283 defined in the end wall 285 by the circular uninterrupted score line 286. The score line 286 is preferably of the nondetachable type as shown in FIG. 3A, and it is seen in FIGS. 55 and 56 that the rivet 284 is off-center with respect to the openable member 283 defined by the score line 286.

The opening tab 282 includes a pair of score break dimples 287*a* and 287*b*which extend downwardly from the underside of the opening tab to contact the outside of the end wall 285. A pair of lock dimples 288*a* and 288*b* extend into the outer surface of the end wall 285, with each lock dimple being aligned with a correspondingly-suffixed one of the score break dimples.

The opening tab 282 has a flange 292 which is spaced a distance above the end wall 285, and which overhangs at least a portion of the score line 286. The opening tab 282 also has a ring member 293 extending substantially parallel to the end wall 285, from the opposite side of the rivet 292 from the score break dimples 287*a* and 287*b*, with the ring member having a ring opening 294 formed in part by a flange 295 which turns downwardly from the front portion 296 of the ring opening.

Figure 57:
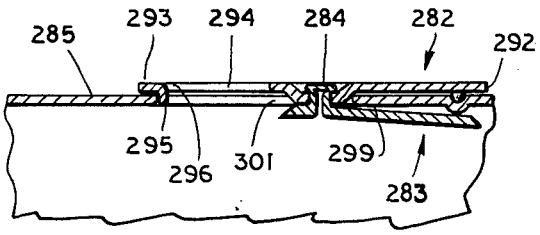
FIG. 57 is another section view taken along line 56—56, showing the end member fully opened.

Opening of te embodiment depicted in FIGS. 54–57 is initially similar to that of the embodiment shown in FIGS. 48–53, with finger pressure being directed downwardly onto the opening tab 282 to cause rupture of the score line 286. The opening tab 282 and the attached openable member 283 are then slidabliy moved to the right as shown in FIG. 57, whereat the rearward edge 299 of the opening formed by removal of the openable member is received within the channel 300 between the opening tab and the openable member. The movement of the opening tab 282 to the position shown in FIG. 57 also aligns the ring opening 294 with the opening 301 formed in the end wall 285 by removal of the openable member 283, and the flange 295 drops downwardly into the opening 301 to cover sharp or rough edges of that opening.

Figure 58:
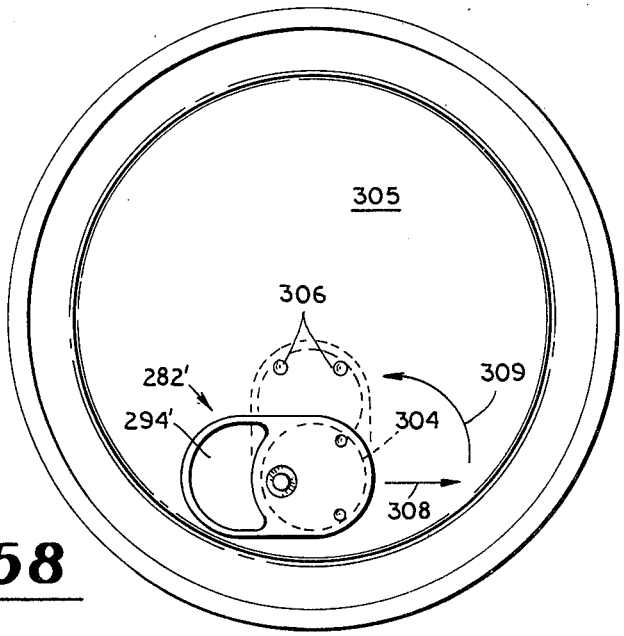
FIG. 58 is a top plan view showing an alternative version of the embodiment shown in FIG. 54.

A modification of the embodiments shown in FIGS. 54–57 is seen in FIG. 58, wherein there is an opening tab 282' which is secured to an underlying opening member 304 in a manner substantially similar to that shown in FIG. 54. It is apparent from FIG. 58, however, that the longitudinal dimension of the opening tab 282 is disposed approximately perpendicular to the diameter of the container end wall 305. The opening tab 282 and attached openable member, after being separated from the end wall 305 in the manner described above, is displaced by an initial sliding movement in a first direction indicated by the arrow 308 to uncover the newly-formed opening in the end wall, followed by a subsequent rotating movement in a second direction indicated by the arrow 309 to orient the ring opening 294' for drinking from the container. The lock dimples can be provided on the end wall 305 at the location 306 which is aligned with the final movement location of the opening tab 282'. The embodiment shown in FIG. 58, accordingly, demonstrates that the openable member of the present invention can be positioned on a container wall in orientations other than the traditional alignment with a diameter of a circular end wall, for the purpose of locating the pouring/drinking opening closer to the chime of the container to facilitate consumption of the contents directly from the container.

It will further be obvious that the foregoing relates only to disclosed embodiments of the present invention, and that numerous alterations and modifications may be made therein without departing from the spirit and the scope of the invention as defined in the following claims.

What is claimed is:

1. Easy opening wall structure for a container, comprising:

a wall having an outer side and an innter side;

an openable member defined in said wall by a selectably separable region of weakness completely surrounding said openable member;

opening tab means disposed on said openable member and including a portion which overhangs at least part of said separable region for contacting said outer side to prevent said openable member from becoming moved more than a predetermined distance inwardly relative to said wall, and to support said opening tab means for sliding displacement along said outer side when said separable region becomes separated;

said opening tab means having force receiving area to receive an externally applied force directed toward said openable member; and means associated with said opening tab means to direct said externally applied force to a location in the vicinity of said separable region, so that said force is applied to initiate the separation of said separable region.

2. Apparatus as in claim 1, wherein said overhanging portion of said opening tab means supports said separated openable member for displacement movement beneath and substantially parallel to said wall.

3. Apparatus as in claim 2, further comprising:

locking means operative to retain said separated openable member in place when said openable member has undergone a certain extent of said displacement movement away from said opening formed in the wall.

4. Apparatus as in claim 1 wherein:

said overhanging portion of said opening tab means supports said separated openable member for displacement movement beneath said wall; and further comprising means disposed between said displaced openable member and the inner side of said wall to maintain said displaced openable member spaced apart from said wall, so as to provide a vent passage which allows air to enter the container while the contents of the container are withdrawn through said opening in the wall.

5. Apparatus as in claim 1, wherein:

said overhanging portion is operative to support said separated openable member for a limited extent of sliding displacement relative to said wall, so that such opening in said wall is uncovered by said sliding displacement of said separated openable member.

6. Apparatus as in claim 5, wherein:

said separable region defining said openable member in said wall includes a pair of opposed spaced-apart mutually convergent lines of separation;

said overhanging portion includes surface means positioned to be received between the convergent edges which are provided by said convergent lines of separation when said openable member becomes separated from said wall; and said surface means is operative to engage said convergent edges when said separated openable member is slidingly displaced a predetermined distance relative to said wall, so that the maximum extent of such sliding displacement is limited by engagement between said surface means and said convergent edges.

7. Apparatus as in claim 1, wherein:

said opening tab means is asssymetrially positioned on said openable member and occupies only a portion of said openable member, so that the remaining extent of the openable member is unobstructed from sliding beneath the inner side of said wall when said openable member is separated from said wall and slidingly displaced in a predetermined direction; and said overhanging portion of said opening tab overhangs the sides of said opening alongside said predetermined direction of sliding displacement.

8. Apparatus as in claim 2, further comprising:

means on said openable member which is engageable with the periphery of said opening when said separable region is separated, so that said engaging means prevents said openable member from being withdrawn through said opening.

9. Apparatus as in claim 1, wherein:

said force receiving area comprises means located on said opening tab means in position to distribute said externally applied force nonuniformly to said separable region.

10. Apparatus as in claim 1, wherein:

said separable region comprises a score line formed in said wall, said score line being defined by a pair of side walls;

one side wall of said score being proximately perpendicular to said outer side; and the other side wall of said score line being angularly inclined inwardly toward said openable member and joining said one side wall at an acute included angle.

11. Apparatus as in claim 1, wherein said opening tab means is a separate member which is secured to the outer side of said openable member.

12. Apparatus as in claim 11, further comprising rivet means formed in said openable member and extending through a rivet-receiving opening defined in said separate member to secure together said separate member and said openable member.

13. Apparatus as in claim 11, wherein said separate opening tab means is secured to said openable member at a location which is assymetrically positioned on said openable member.

14. Apparatus as in claim 13, wherein:

said opening tab means includes a ring member defining a ring opening and supported in radially offset relation to the axis about which opening tab means is rotatable within the opening formed in said wall;

said ring opening positioned to be moved by said rotation into alignment with at least a portion of the opening formed in said wall, so that the edge of said opening portion is covered on the outer side of said wall by said ring member.

15. Apparatus as in claim 14, further comprising:

means on said ring member operative to engage said wall and retain said opening tab means in position with said ring opening aligned with said opening portion.

16. Apparatus as in claim 1, wherein:

said opening tab means overhangs substantially the entire extent of said separable region.

17. Apparatus as in claim 16, wherein a portion of said opening tab means is displaceable from an underlying portion of said openable member to define a region within which part of said wall can be received when said separated openable member is displaced away from said opening in the wall.

18. Apparatus as in claim 1, wherein:

said opening tab means is a separate member which is secured to a location on said openable member; and said means to direct force is disposed between and in mutually contacting relation with said opening tab means and said openable member in spaced apart relation to said location of securement, so that said externally applied force is transmitted from said opening tab means to said openable member at least through said force transmitting means.

19. Apparatus as in claim 18, wherein said mutually contacting relation is in close proximity to a location on said separable region.

20. Apparatus as in claim 16, further comprising:

ring means extending from said opening tab means in substantially flat and parallel relation to said wall; and said ring defining means defining a ring opening which is disposed for movement into alignment with said opening in said wall when said separated openable member undergoes said displacement.

21. Easy opening wall structure for a container, comprising:

a wall having an outer side and an inner side;

an openable member defined in said wall by a selectably separable region of weakness, and having a portion which is displaced relative to said outer side;

opening tab means disposed on said openable member and extending a distance outwardly beyond said outer side of said wall, said opening tab means including a portion which overhangs at least part of said separable region;

said opening tab means having a force receiving area to receive an externally applied force directed toward said openable member so that such force is transmitted to said separable region, whereupon said overhanging portion moves into contact with said wall when said separable region becomes completely separated and said openable member moves a limited distance inwardly relative to said wall;

means on said separated openable member to contact said wall so as to prevent withdrawal of said separated openable member through the opening formed in said wall by completely separating said separable region, and so as to support said openable member on said inner side for a limited extent of sliding displacement which displaces a portion of said openable member away from said opening;

said opening tab means overhangs at least a sufficient extent of said separable region for contacting the outer side of said wall to prevent said opening tab means from freely passing through said opening formed in said wall and to support said opening tab means for sliding displacement along said outer side of said wall, when said openable member becomes separated from said wall, so that said opening tab means and said openable member disposed therewith are prevented from freely entering the container and can be slidably displaced to expose said opening; and said opening tab means has a portion which is displaced to conformingly fit said displaced portion of said openable member.

22. Apparatus as in claim 21, wherein:

said opening tab means is a separate member which is secured to said openable member by means which leaves said displaced portion of said opening tab means free to become separated from said displaced portion of said openable member, so as to define a region for receiving part of said wall when said separated openable member is slidably displaced away from said opening in said wall; and means defining a displaced region on the outer side of said wall in spaced apart relation to said openable member, said displaced wall region being located to receive said displaced portions of said slidably displaced opening tab means and said openable member.

23. Apparatus as in claim 16, further comprising bead means peripherally surrounding and extending outwardly from said separable region.

24. Apparatus as in claim 16, wherein said overhanging portion of said opening tab means includes means positioned to receive container contents sprayed outwardly from the container upon separation of said separable region and to deflect said sprayed contents toward said upper surface of said wall.

25. An easy opening container comprising:

a container wall having an inner side facing into the container, and having an outer side;

an openable member defined in said wall by a selectably separable region of weakness;

flange means extending outwardly from said openable member and overhanging at least a portion of said separable region;

means associated with said flange means and responsive to externally applied force directed against said flange means to apply said force to assist in separating said separable region; and means on said openable member defining a necked region which is disposed outwardly from said wall between said flange means and said unseparated separable region, said necked area having a dimension which is less than the corresponding dimension across selected edge portions of said separable region, so that said necked area engages said edge portions and supports said separated openable member on said edge portions for slidable movement relative to said wall to displace a portion of the engaged openable member away from the opening formed in said wall by separating said separable region.

26. Structure as in claim 25, wherein:

said openable member is defined in said wall by a closed separable region, so that said openable member becomes completely separated from the remainder of said wall when said separable region is completely separated.

27. Structure as in claim 25, wherein:

said openable member is defined in said wall by a separable region which in interrupted by a nonseparable region, so that said openable member remains connected to the remainder of said wall when said separable region is completely separated.

28. A container as in claim 25, wherein:

said openable member includes a tab member which is defined in said wall by said separable region and which is offset on said openable member from said flange means, so that said tab means enters said container and becomes maintained below the inner side of said wall for relative displacement when said separable region becomes separated and said openable member moves inwardly to an extent limited by contact of said flange means with said outer side of said wall.

29. A container as in claim 28, wherein:

said necked area is at an intermediate location on said openable member and retains the separated openable member for rotation relative to said wall; and said tab means is spaced apart from said necked area, so that said tab means becomes displaced beneath said wall to expose an opening in the wall when said separated opening means is rotated.

30. A container as in claim 28, wherein:

said necked area is located at one end of said openable member and retains the separated openable member for sliding movement relative to said wall;

so that said tab means slides beneath said wall as said separated openable member is slidably displaced relative to the wall to expose the opening in the wall.

31. A container as in claim 30, further comprising means to separate said tab means from said inner side of said wall when said tab means slides beneath the wall, so that said tab means is separated from the inner side sufficiently to provide air vent access to the interior of the opened container.

32. Easy opening wall structure for a container, comprising:

a wall having an outer side and an inner side;

an openable member defined in said wall fracturable web at the root of a score line surrounding said openable member;

opening tab means disposed on said openable member and including a portion which overhangs at least part of said score line;

said opening tab means having a force receiving area to receive an externally applied force directed toward said openable member whereby such force is transmitted to the vicinity of said score line to fracture and completely separate said web of said score line, whereupon contact of said overhanging portion with said wall prevents said opening tab means and said completely separated openable member from freely entering the container through the opening formed in said wall by said separation; and means retaining said separated openable member on said inner side of said wall for a limited extent of sliding displacement slides said separated openable member and said opening tab means away from the opening formed in said wall.

33. Structure as in claim 32, wherein:

said opening tab means is a separate member which is attached to a location on said openable member; and further comprising means to direct said externally applied force toward said outer side of said wall in the vicinity of said score line.

34. Structure as in claim 32, wherein said score line is fracturable to provide an opening having a peripheral overhang which obstructs withdrawal of said separated openable member through said opening.

35. Easy opening wall structure for a container, comprising:

a wall having an outer side and an inner side;

an openable member defined in said wall by a selectably separable region of weakness completely surrounding said openable member;

separate opening tab means attached to a location on said openable member and including a portion which overhangs at least part of said separable region to define a channel between said opening tab means and said outer side of said wall, thereby supporting said opening tab means for sliding displacement along said outer side of said wall supporting and said separated openable member for sliding displacement along said inner side of said wall;

said opening tab means having a force receiving area to receive an externally applied force directed toward said openable member;

means associated with said openable member adjacent said separable region to engage the periphery of the opening which is formed in said wall by separation of said separable region, so as to prevent withdrawal of the separated openable member through said opening; and force transmitting means on said opening tab means in spaced apart relation to said location of attachment on said openable member, so that said externally, applied force is partially transmitted from said opening tab means to said openable member through said force transmitting means.

36. The structure as in claim 35, wherein said force transmitting means is disposed to contact said openable member in the vicinity of a location on said separable region.

37. The structure as in claim 35, wherein said force transmitting means comprises means located on the underside of said opening tab means.

38. Easy opening wall structure for a container, comprising:

a wall having an outer side and an inner side;

an openable member defined in said wall by a selectably separable region of weakness completely surrounding said openable member on a plane;

at least a portion of said openable member being deformed inwardly from said plane;

separate opening tab means attached to said inwardly deformed portion of said openable member;

said opening tab means having a force receiving area to receive an externally applied force directed toward said openable member; and said opening tab means having means which overhangs at least part of said separable region so as to support said opening tab means and said openable member attached thereto for sliding displacement along said wall upon separation of said separable region.

39. Structure as in claim 38, wherein said region of weakness is separable to provide an opening having a peripheral overhang which obstructs withdrawal of said separated openable member through said opening.

40. The structure as in claim 38, further comprising force transmitting means on said opening tab means to transmit said externally applied force from said opening tab means to the vicinity of said separable region.

41. Easy opening wall structure for a container, comprising:

a wall having an outer side and an inner side;

an openable member defined in said wall by a fracturable web at the root of a continuous score line surrounding said openable member;

opening tab means disposed on said openable member and including a portion which overhangs at least a sufficient extent of said score line so as to support said opening tab means for slidable displacement along said outer side of said wall, upon fracture of said web;

means associated with said opening tab means to overhang a sufficient extent of said score line so as to support said opening tab means for slidable displacement along said outer side of said wall, upon fracture of said web;

said opening tab means having a force receiving area to receive an externally applied force directed toward said openable member; and means to direct said externally applied force toward said outer side of said wall in the vicinity of said score line to fracture said web of said score line, whereupon engagement of said overhanging portion with said wall prevents said openable member from moving more than a limited distance inwardly away from said wall.

42. The structure of claim 41, wherein said force directing means comprises means locating said opening tab means in assymetrical relation to said openable member, so that a nonuniform force is applied to fracture said separable region.

43. The structure of claim 41, wherein said force directing means comprises means on said opening tab means to engage the vicinity of said score line.

44. Structure as in claim 41, wherein said score line is fracturable to provide an opening having a peripheral overhang which obstructs withdrawal of said openable member through said opening.

45. Easy opening wall structure for a container, comprising:

a wall having an outer side and an inner side;

an openable member defined in said wall by a selectably separable region of weakness;

opening tab means disposed on said openable member and having a force receiving area to receive an externally applied force directed toward said openable member; and said opening tab means overhanging at least part of said separable region and having a portion which is in contact with a location in the vicinity of said region of weakness when said force is applied to said opening tab means, so that said region of weakness becomes completely separated as a result of the force applied to said vicinity.

46. Apparatus as in claim 38 further comprising protruding means formed in said wall outside of said openable member and extending outwardly at least as far as the outward extent of said opening tab means and at least partially surrounding said opening tab means.

47. Apparatus as in claim 38 wherein said openable member is elongate and has a medial portion defined by a curvilinear extent of said separable region;

said overhanging portion includes a peripheral surface on said opening tab means which is disposed outwardly from said outer side of said wall, and which is configured to be rotatably supported within the curvilinear edge which partially defines said opening when said curvilinear extent is displaced inwardly.

* * * * *